United States Patent [19]

Young

[11] Patent Number: 4,675,633

[45] Date of Patent: Jun. 23, 1987

[54] WAVEGUIDE EXPANSION JOINT

[75] Inventor: Lock R. Young, Palm Bay, Fla.

[73] Assignee: Harris Corporation, Melbourne, Fla.

[21] Appl. No.: 762,189

[22] Filed: Aug. 5, 1985

[51] Int. Cl.[4] ..... H01P 1/06

[52] U.S. Cl. ..... 333/257; 285/302

[58] Field of Search ..... 333/254, 256, 257; 285/66, 302

[56] References Cited

U.S. PATENT DOCUMENTS

| | | | |
|---|---|---|---|
| 315,287 | 4/1885 | Hobart | 285/302 X |
| 330,392 | 11/1885 | Gray | 285/302 X |
| 2,564,007 | 8/1951 | Hochgraf | 333/257 X |
| 2,644,028 | 6/1958 | Bernet . | |
| 2,656,515 | 10/1953 | Hansen et al. | 333/257 X |
| 3,786,377 | 1/1974 | Spinner . | |
| 3,822,412 | 7/1974 | Carlin et al. . | |
| 3,936,080 | 2/1976 | Bennett | 285/302 X |
| 4,158,825 | 6/1979 | Guenther et al. . | |
| 4,247,838 | 1/1981 | Sirel . | |
| 4,369,413 | 1/1983 | Devan et al. . | |

FOREIGN PATENT DOCUMENTS

| | | | |
|---|---|---|---|
| 1560533 | 2/1980 | United Kingdom | 333/257 |

*Primary Examiner*—Paul Gensler

*Attorney, Agent, or Firm*—John L. DeAngelis, Jr.

[57] ABSTRACT

A waveguide expansion joint for connecting two circular waveguides operating in the $TE_{01}$ mode while allowing for waveguide expansion and contraction due to temperature variations. The expansion joint includes first and second rings on the outside surface at one end thereof. When the expansion joint is inserted into a waveguide the rings are proximate to the inside diameter of the waveguide for absorbing undesired propagating modes, for pressurization of the expansion joint, and for coaxially aligning the waveguide and the expansion joint.

39 Claims, 8 Drawing Figures

WAVEGUIDE EXPANSION JOINT

FIELD OF THE INVENTION

This invention relates to an expansion joint for connecting sections of a waveguide that permits expansion and contraction of the waveguide sections without distortion of the electromagnetic energy propagating therein.

BACKGROUND OF THE INVENTION

Electromagnetic transmission systems often employ waveguide sections that are rigidly supported within a surrounding conduit. The waveguide requires the use of expansion joints to accommodate for temperature-induced expansion and contraction of the connected waveguide sections. For example, in long runs of low-loss circular waveguide operating in the $TE_{01}$ mode, the variation in overall length of the waveguide with temperature may be on the order of inches. A slip joint or expansion joint is necessary to allow for this length variation in such a run where the ends are fixed. The waveguide may also be pressurized to form a barrier against the leakage of moisture into the waveguide. Thus the slip joint must be sealed to prevent loss of pressurization.

Various tapered joints have been employed in expansion joints for $TE_{01}$ mode transmission waveguides. One such tapered expansion section is exemplified by U.S. Pat. No. 4,369,413 issued to Devan et al. The Devan expansion joint provides a mechanical expansion capability and taper transition between different operating waveguide diameters, while minimizing the generation of unwanted modes, especially the $TE_{02}$ mode. Devan accomplishes this with a two-piece expansion joint; the first piece increases in diameter linearly from the diameter of the waveguide to which it is to be connected, to a diameter that is sufficiently small to prevent the generation of spurious modes (especially the $TE_{02}$ mode) and equal to the inside diameter of the second piece. The second waveguide piece is concentrically and precisely fitted in slideable engagement with the first waveguide piece. The first and second waveguide pieces are arranged to permit sliding with respect to each other to provide the expansion and contraction capability. The second waveguide piece has at one end thereof an internal diameter that is equal to the enlarged diameter of the first waveguide piece. At the other end of the second waveguide piece there is a cosine or other specially shaped section to enlarge the joint to the diameter of the other waveguide to which it is to be connected.

Although this prior art expansion joint provides some expansion and contraction capability, it is limited by the frictional forces created by the precise fit where the outside surface of the first piece and the inside surface of the second piece are in contact. In the prior art designs this frictional force is necessary to provide alignment of the waveguide and the expansion joint and to prevent the emission of the propogating energy from the waveguide into free space. These disadvantages are overcome by the present invention.

SUMMARY OF THE INVENTION

Although the prior art expansion/contraction waveguide joints provide satisfactory operation and attenuation of undesired modes, it is desirable to provide an expansion joint having a simplified geometry, lower frictional forces to provide easier sliding between waveguide sections, substantial attenuation of undesired modes, and ease of manufacture and installation.

A waveguide expansion joint is adapted for joining a first circular waveguide with a second circular waveguide for propagating electromagnetic energy in a preselected mode, typically the $TE_{01}$ mode. The first end of the waveguide expansion joint has an outside diameter approximately equal to the inside diameter of the first circular waveguide to which it is to be connected. The first end of the expansion joint and the first circular waveguide are connected by slideable concentric engagement. The second end of the expansion joint has an outside diameter slightly less than the inside diameter of the second circular waveguide. The second end of the expansion joint and the second circular waveguide are connected by slideable engagement of the expansion joint into the waveguide, with the volume between the outside diameter of the waveguide and the inside diameter of the expansion joint (at the second end thereof) filled by a ring member concentric with the expansion joint. In one embodiment, the ring member serves three purposes: (1) absorbs electromagnetic energy propagating in undesirable modes in the gap between the inside diameter of the waveguide and the outside diameter of the expansion joint, thus preventing the radiation thereof into free space; (2) seals the gap to maintain waveguide pressurization; and (3) coaxially aligns the expansion joint and the waveguide. In other embodiments, these three functions are provided by one or more rings of proper size and composition. For example, in one embodiment a ferrite ring provides the absorption characteristic, a first "O" ring provides the sealing, and a second "O" ring (in conjunction with the first) provides the required alignment. The electromagnetic energy propagates through the expansion joint from the first end to the second end thereof.

The expansion joint of the present invention also offers ease of installation at the site. All the waveguide is first put in place, except the final section and the expansion joint contained within it. After measuring the gap to determine the length of the final section, the final section is cut a few inches shorter than this gap. The expansion joint is adjusted as needed within the final section to complete the waveguide run. This adjustable feature of the inventive expansion joint offers a significant advantage when the waveguide run is fabricated by removing the necessity for close tolerances for the waveguide sections.

BRIEF DESCRIPTION OF THE DRAWINGS

The present invention may be better understood, and the further advantages and uses thereof more readily apparent, when considered in view of the following detailed description of exemplary embodiments, taken with the accompanying drawings in which.

DESCRIPTION OF THE PREFERRED EMBODIMENTS

It is known that the $TE_{0N}$ propagating modes have only circumferential wall currents, while all other modes have some longitudinal wall currents. Therefore, any circumferential cut in the wall of a waveguide is virtually invisible to the $TE_{0N}$ modes but allows all other modes to radiate through the cut. High power waveguide runs are usually sized to allow only the $TE_{01}$ mode to propagate, with the $TE_{02}$ mode and the remaining $TE_{0N}$ modes cut off. There are, therefore, eight modes that can propagate in the waveguide, i.e., the desired $TE_{01}$ mode and seven undesirable modes. Any circular asymmetry in the waveguide causes mode conversion from the $TE_{01}$ mode to one of the undesired modes.

Figure 1:
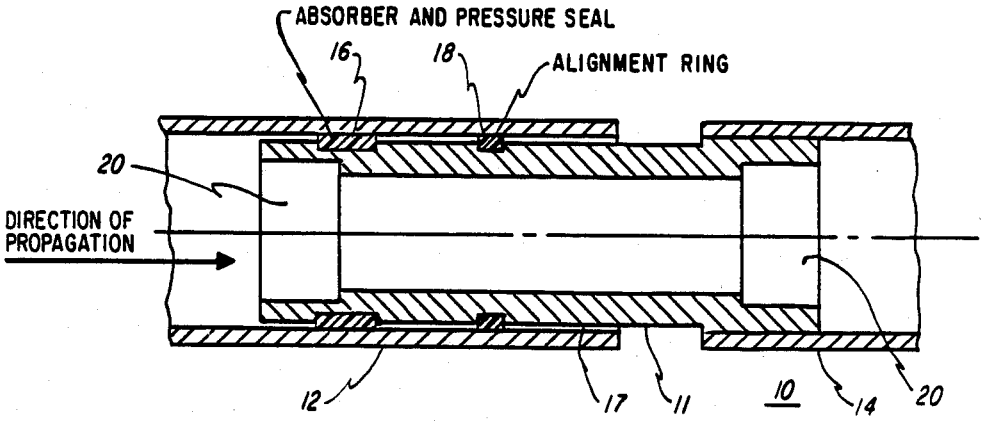
FIG. 1 is a cross-sectional illustration of a preferred embodiment of an expansion joint constructed according to the teachings of the present invention.
Figure 5:
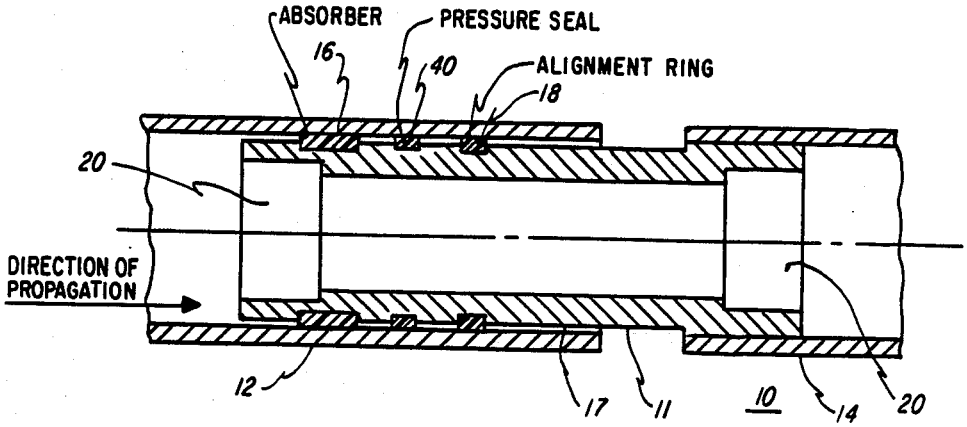

The expansion joint of the present invention is shown in cross-sectional form in FIG. 1 and designated generally by the reference character 10. The expansion joint 10 includes a waveguide member 11 having a step transition therein and slideably engaged in coaxial orientation with a waveguide 12 and a waveguide 14. In use, the waveguide 12 would typically be a long waveguide run, only the end of which is shown in FIG. 1; the other end being fixed. Assuming the direction of propagation indicated, the waveguide 14 would typically be connected to a receiving device. The expansion joint 10 is, however, reciprocal allowing electromagnetic energy to propogate in either direction through it. The waveguide 14 would therefore be a relatively short length and also rigidly fixed. To allow for expansion and contraction of the waveguide 12, the expansion joint 10 is, as discussed, slideably engaged in the waveguide 12. At one end of the waveguide member 11 the outside diameter thereof equals the inside diameter of the waveguide 14 into which the waveguide member 11 fits, forming a rigid junction and preventing relative movement thereat. The other end of the waveguide member 11 has an outside diameter slightly less than the inside diameter of the waveguide 12 into which the waveguide member 11 fits. Thus, a gap 17 is formed at this junction so as to allow expansion or contraction movement of the waveguide 12 within the expansion joint 10. The expansion joint 10 also includes an absorber and pressure seal 16 oriented coaxially with the waveguide member 11 at the end thereof that is to fit into the waveguide 12. The absorber and pressure seal 16 is necessary to absorb undesired modes that might radiate from the gap 17 between the inside diameter of the waveguide 12 and the outside diameter of the waveguide member 11. In the preferred embodiment, the absorber and pressure seal 16 is constructed of a carbon-loaded silicone rubber that provides both mode absorption and pressure sealing of the joint between the waveguide member 11 and the waveguide 12. This pressure seal is necessary to seal the joint and maintain waveguide pressure. The absorber and pressure seal 16 also holds the waveguide member 11 and the waveguide 12 in the proper orientation as shown in FIG. 1. An alignment ring 18 is also placed in coaxial orientation with the waveguide member 11 as shown in FIG. 1. As shown, the absorber and pressure seal 16 and the alignment ring 18 provide proper coaxial alignment of the expansion joint 10 and the waveguide 12. The alignment ring 18 can be fabricated of any stable, low-friction, dielectric (usually) material. In lieu of using the alignment ring 18, in another embodiment of the present invention the final alignment may be accomplished with a series of pins, studs, or a split ring as is well known in the art. Alternatively, the absorber and pressure seal 16 can provide only the mode-absorbing function, with two or more rings for alignment (including the alignment ring 18) and one or more rings for pressure sealing. FIG. 5 shows an embodiment of the expansion joint 10 wherein the absorber ring 16 provides only the mode-absorbing function, and a pressure seal 40 provides pressure sealing of the gap 17.

The expansion joint 10 also includes one section at each end thereof having a slightly larger inside diameter than the main diameter of the expansion joint 10. These sections are shown generally with reference character 20 in FIG. 1. The sections 20 are quarter-wavelength transformers for providing impedance matching between the expansion joint and the waveguides 12 and 14.

An exemplary embodiment of an expansion joint 10 constructed according to the teachings of the present invention was designed in 3.027 inch inside-diameter waveguide for the 7.9 to 8.4 GHz frequency band. The return loss in this frequency band was approximately 35 dB or less than 1.04:1 VSWR. The higher order mode leakage in this exemplary embodiment was more than 70 dB down. This exemplary embodiment of expansion joint 10 also allowed for more than six inches of length variation due to temperature changes.

Figure 2:
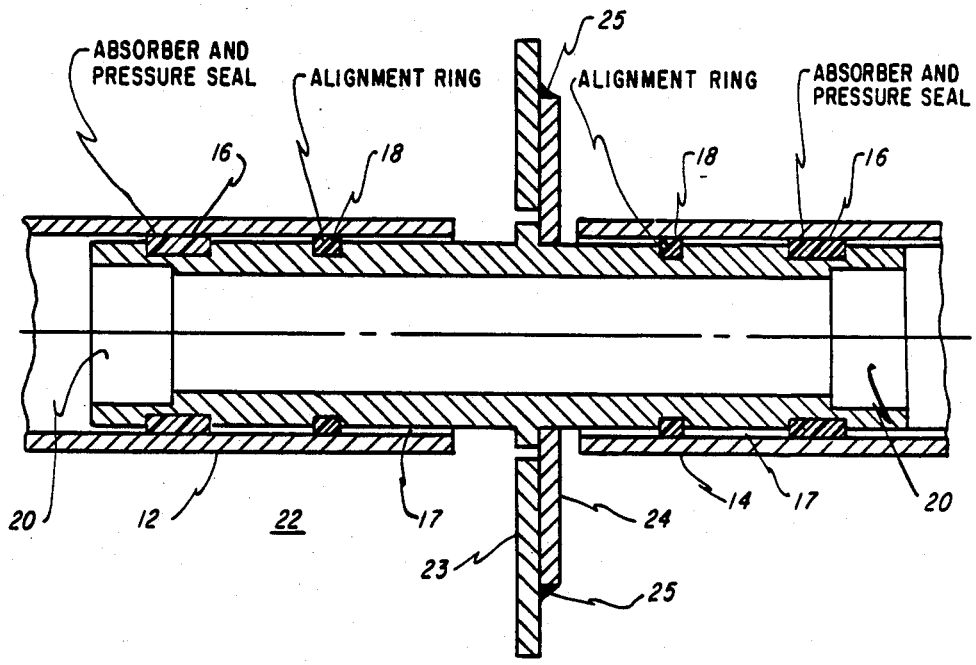
FIG. 2 is a cross-sectional illustration of a preferred embodiment of a coupling joint constructed according to the teachings of the present invention.
Figure 3:
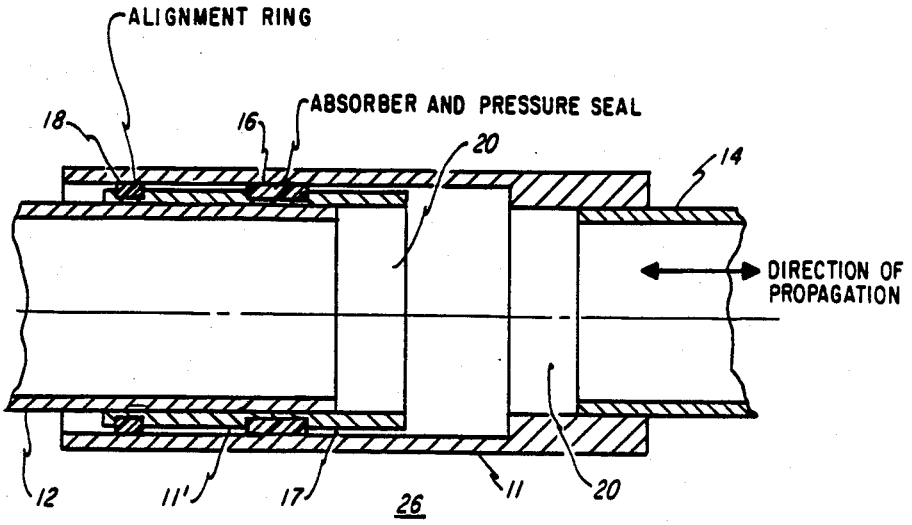
FIG. 3 is a cross-sectional illustration of a second embodiment of an expansion joint constructed according to the teachings of the present invention.
Figure 6:
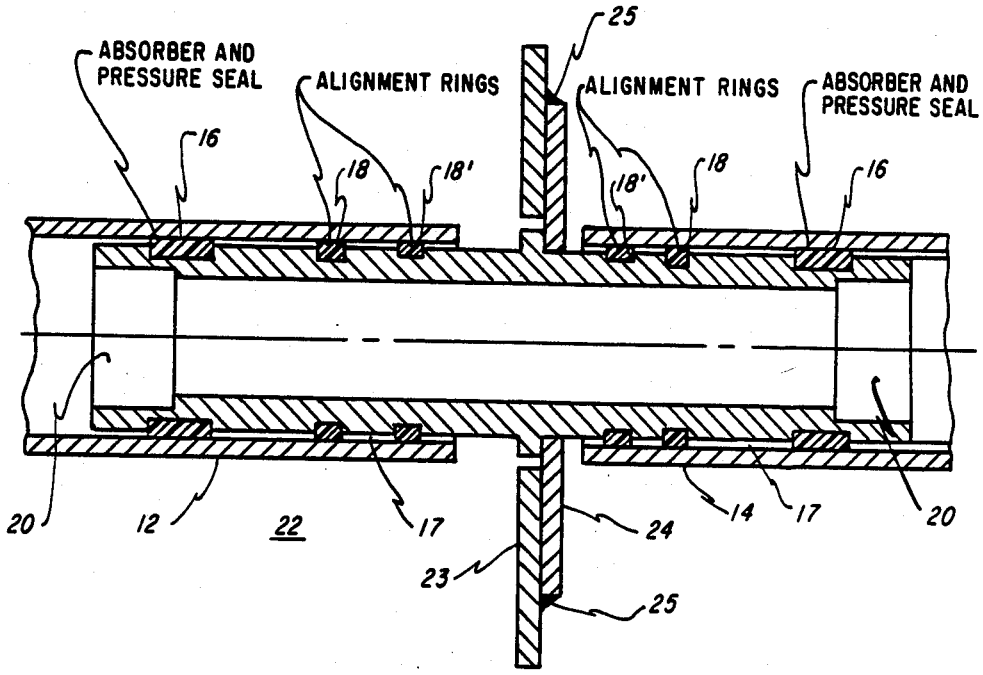

FIG. 2 shows a coupling joint 22 constructed according to the teachings of the present invention. The coupling joint 22 couples two waveguides 12 and 14 without the use of flanges, as required by the well-known prior art designs. The ends of the waveguides 12 and 14 may be rough cut and the coupling joint 22 inserted between them. In this embodiment there are two gaps 17 to allow expansion and contraction movement of both waveguides 12 and 14, two absorber and pressure seals 16, and two alignment rings 18 for aligning the waveguides 12 and 14. As discussed in conjunction with the expansion joint 10 illustrated in FIG. 1, the absorber and pressure seal 16 absorbs undesired modes propagating in the waveguide 12 or the waveguide 14, maintains a pressure seal, and provides the frictional forces to hold the coupling joint 22 inside the waveguides 12 and 14. In conjunction with the alignment rings 18, the absorber and pressure seals 16 ensure coaxial alignment of the waveguides 12 and 14 and the coupling joint 22. Electromagnetic energy can propagate in either direction in the FIG. 2 embodiment (and in the embodiments of FIGS. 1 and 3). The embodiment of FIG. 2 is especially suitable for use as feed-through for a metal electromagnetic pulse (EMP) or electromagnetic interference (EMI) barrier that requires rigid and tight attachment of the waveguide to the wall. A hole is cut through the EMP/EMI wall (identified by reference character 23) and a flange 24 is attached (by suitable means such as silver solder) to the expansion joint 22. The flange 24 is welded to the EMP/EMI wall 23 as shown generally by reference character 25. FIG. 6 illustrates another embodiment of the coupling joint 22 including two alignment rings 18 and 18' at each end of the coupling joint 22.

The expansion joint 10 and the coupling joint 22 are used when the frequency band of operation is near but slightly below the $TE_{02}$ cutoff frequency. If the operation band is significantly below the $TE_{02}$ cutoff frequency, but very near the $TE_{01}$ cutoff, an inverse type expansion joint, shown in FIG. 3, can be used. Operation of the inverse expansion joint 26 is similar to that of the expansion joint 10 and the coupling joint 22 except the waveguide member 11 includes a section 11' located between the gap 17 and the waveguide 12. The inside diameter of the waveguide member 11 should be beyond cutoff for the $TE_{02}$ mode in the band of operation. As indicated, electromagnetic energy can propagate in either direction through the expansion joint 26.

Figure 4:
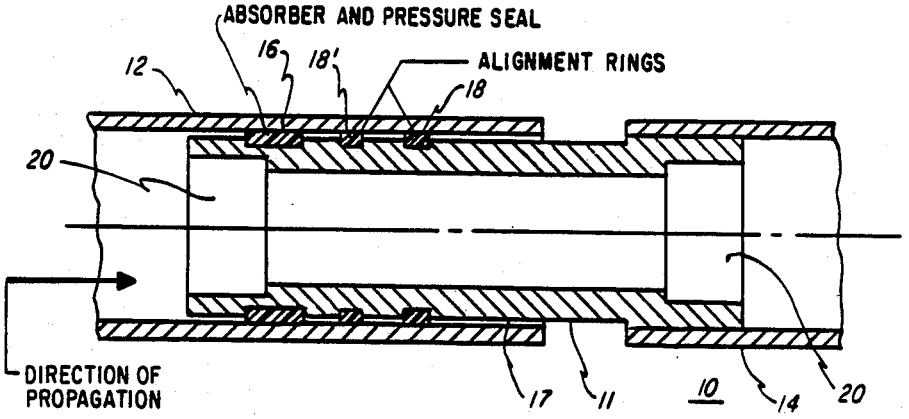
FIGS. 4 through 8 are cross-section illustrations of additional embodiments of an expansion joint constructed according to the teachings of the present invention.

FIG. 4 is a slight modification of FIG. 1, wherein two alignment rings 18 and 18' are used to provide proper alignment between the waveguide 12 and the waveguide member 11.

Figure 7:
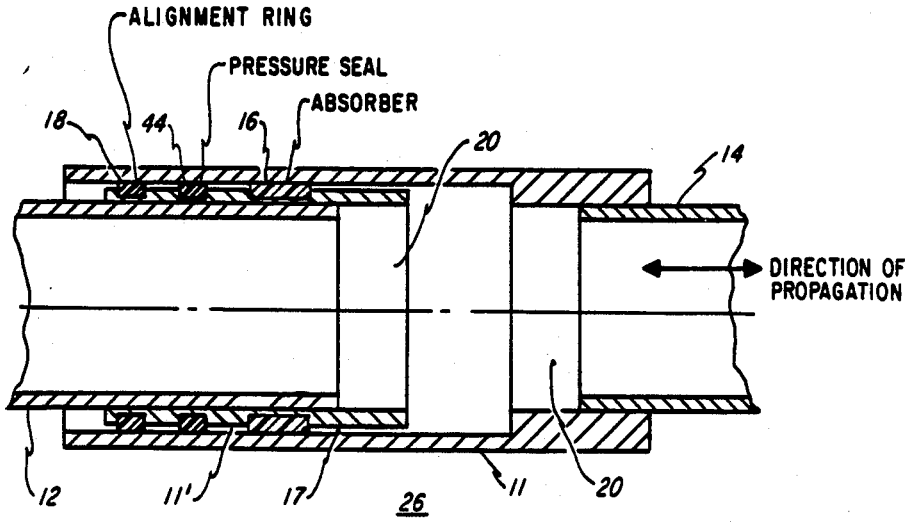
Figure 8:
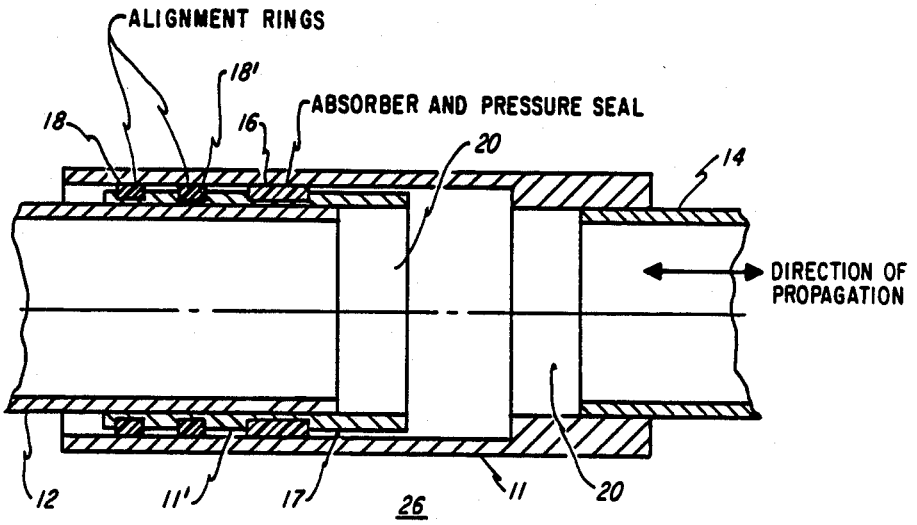

In FIG. 7 there is another embodiment having a single alignment ring 18, a pressure seal 44, and an absorber 16. In this embodiment the absorber 16 provides only the electromagnetic energy absorption function as discussed above, while the pressure seal 44 pressure seals the gap 17.

Although several embodiments in accordance with the present invention have been shown and described, it is understood that the same is not limited thereto but is susceptible of numerous changes and modifications as known to a person skilled in the art, and I therefore do not wish to be limited to the details shown and described herein, but intend to cover all such changes and modifications as are obvious to one of ordinary skill in the art.

What is claimed is:

1. A waveguide expansion joint adapted for joining a first circular waveguide with a second circular waveguide for propagating electromagnetic energy in the microwave range in a preselected mode, said waveguide expansion joint comprising:

a circular waveguide section, at the first end having an outside diameter approximately equal to the inside diameter of the first circular waveguide, the first end of said circular waveguide section being adapted for coaxial engagement with the first circular waveguide;

the second end of said circular waveguide section having an outside diameter less than the inside diameter of the second circular waveguide for slideable engagement therewith so as to form a coaxial gap between the inside surface of the second circular waveguide and the outside surface of said circular waveguide section, wherein the second circular waveguide is free to move relative to said circular waveguide section;

absorber means for absorbing energy propagating in a mode other than the preselected mode and for preventing the emission of electromagnetic radiation from the gap into free space; and alignment means providing coaxial alignment of said circular waveguide section and the first circular waveguide.

2. The waveguide expansion joint of claim 1 wherein the preselected mode is the $TE_{01}$ mode.

3. The waveguide expansion joint of claim 1 wherein the first end of the circular waveguide section is in contacting relation with the first circular waveguide.

4. The waveguide expansion joint of claim 1 wherein the absorber means includes an absorber ring attached to the outside surface of the circular waveguide section near the second end thereof, said absorber ring in a coaxial arrangement with the circular waveguide section for contacting the inside surface of the second circular waveguide when the circular waveguide section is slideably engaged therein.

5. The waveguide expansion joint of claim 4 wherein the absorber ring is formed of a ferrite-based material.

6. The waveguide expansion joint of claim 4 wherein the absorber ring is formed of carbon-loaded silicone rubber for preventing the emission of electromagnetic radiation from the gap into free space and for pressure sealing the gap.

7. The waveguide expansion joint of claim 4 wherein the alignment means includes an alignment ring attached to the outside surface of the circular waveguide section near the second end thereof, said alignment ring in a coaxial arrangement with the circular waveguide section, said alignment ring and the absorber ring providing coaxial alignment of the circular waveguide section and the second circular waveguide.

8. The waveguide expansion joint of claim 1 wherein the alignment means includes two alignment rings attached to the outside surface of the circular waveguide section near the second end thereof, said alignment rings having coaxial arrangement with the circular waveguide section, said alignment rings for providing coaxial alignment of the circular waveguide section and the second circular waveguide.

9. The waveguide expansion joint of claim 1 including means for pressure sealing the gap to maintain a pressurized condition within the first and the second circular waveguides and the waveguide expansion joint.

10. A waveguide expansion joint adapted for joining a first circular waveguide with a second circular waveguide for propagating electromagnetic energy in the microwave range in a preselected mode, said waveguide expansion joint comprising:

a circular waveguide section, at the first end having an inside diameter approximately equal to the outside diameter of the first circular waveguide, the first end of said circular waveguide section being adapted for coaxial engagement with the first circular waveguide;

the second end of said circular waveguide section having an inside diameter greater than the outside diameter of the second circular waveguide for slideable engagement therewith so as to form a coaxial gap between the outside surface of the second circular waveguide and the inside surface of said circular waveguide section, wherein the second circular waveguide is free to move relative to said circular waveguide section;

absorber means for absorbing energy propagating in a mode other than the preselected mode and for preventing the emission of electromagnetic radiation from the gap into free space; and alignment means for providing coaxial alignment of said circular waveguide section and the second circular waveguide.

11. The waveguide expansion joint of claim 10 where the preselected mode is the $TE_{01}$ mode.

12. The waveguide expansion joint of claim 10 wherein the first end of the circular waveguide section is in contacting relation with the first circular waveguide.

13. The waveguide expansion joint of claim 10 wherein the absorber means includes:

an absorber ring secured to the outside surface of the second circular waveguide, wherein said absorber ring is in a coaxial arrangement with the second circular waveguide for contacting the inside surface of the circular waveguide section when the second circular waveguide is in slideable engagement with the circular waveguide section.

14. The waveguide expansion joint of claim 13 wherein the absorber ring is formed of a ferrite-based material.

15. The waveguide expansion joint of claim 13 wherein the absorber ring is formed of carbon-loaded silicone rubber for preventing the emission of electromagnetic radiation from the gap into free space and for pressure sealing the gap.

16. The waveguide expansion joint of claim 13 wherein the alignment means includes an alignment ring attached to the outside surface of the second circular waveguide, wherein said alignment ring is in a coaxial arrangement therewith, for contacting the inside surface of the circular waveguide section, when the second circular waveguide is in slideable engagement with the circular waveguide section, said alignment ring and the absorber ring for providing coaxial alignment of the circular waveguide section and the second circular waveguide.

17. The waveguide expansion joint of claim 10 wherein the alignment means includes two alignment rings attached to the outside surface of the second circular waveguide in a coaxial arrangement with the second circular waveguide, for contacting the inside surface of the circular waveguide section when the second circular waveguide is in slideable engagement with the circular waveguide section, said alignment rings for providing coaxial alignment of the circular waveguide section and the second circular waveguide.

18. The waveguide expansion joint of claim 10 including means for pressure sealing the gap to maintain a pressurized condition within the first and the second circular waveguides and the waveguide expansion joint.

19. A waveguide coupling joint adapted for coupling a first circular waveguide with a second circular waveguide for propagating electromagnetic energy in the microwave range in a preselected mode, said waveguide coupling joint comprising:

a circular waveguide section having an outside diameter less than the inside diameter of the first and the second circular waveguides, the first and the second ends of said circular waveguide section being adapted for slideably coaxial engagement with the first and the second circular waveguides, respectively so as to form a coaxial gap between the inside surface of the first circular waveguide and the outside surface of said circular waveguide section at the first end thereof, and so as to form a coaxial gap between the inside surface of the second circular waveguide and the outside surface of said said circular waveguide section at the second end thereof, wherein the first and the second circular waveguides are free to move relative to said circular waveguide section;

absorber means for absorbing energy propogating in a mode other than the preselected mode and for preventing the emission of electromagneic radiation from the gaps into free space; and alignment means for providing coaxial alignment of said circular waveguide section and the first and the second circular waveguides

20. The waveguide coupling joint of claim 19 wherein the preselected mode is the $TE_{01}$ mode.

21. The waveguide coupling joint of claim 19 wherein the absorber means includes:

a first absorber ring secured to the outside surface of the circular waveguide section near the first end thereof, said first absorber ring in a coaxial orientation with the circular waveguide section for contacting the inside surface of the first circular waveguide when the circular waveguide section is slideably engaged therein;

a second absorber ring secured to the outside surface of the circular waveguide section near the second end thereof, said second absorber and pressure seal in a coaxial orientation with the circular waveguide section for contacting the inside surface of the second circular waveguide when the circular section is slideably engaged therein.

22. The waveguide coupling joint of claim 21 wherein the first and the second absorber rings are formed of a ferrite-based material.

23. The waveguide coupling joint of claim 21 wherein the first and the second absorber rings are formed of carbon-loaded silicone rubber for preventing the emission of electromagnetic radiation from the gap into free space and for pressure sealing the gap.

24. The waveguide coupling joint of claim 21 wherein the alignment means includes:

a first alignment ring attached to the outside surface of the circular waveguide section near the first end thereof, said first alignment ring having coaxial orientation with the circular waveguide section, said first alignment ring and the first absorber ring for providing coaxial alignment of the circular waveguide section and the first circular waveguide;

a second alignment ring attached to the outside surface of the circular waveguide section near the second end thereof, said second alignment ring having coaxial orientation with the circular waveguide section, said second alignment ring and the second absorber ring for providing coaxial alignment of the circular waveguide section and the second circular waveguide.

25. The waveguide coupling joint of claim 19 wherein the alignment means includes:

two alignment rings attached to the outside surface of the circular waveguide section near the first end thereof and in coaxial arrangement therewith, said alignment rings for providing coaxial alignment of the circular waveguide section and the first circular waveguide; and two alignment rings attached to the outside surface of the circular waveguide section near the second end thereof and in coaxial arrangement therewith, said alignment rings for providing coaxial alignment of the circular waveguide section and the second circular waveguide.

26. A waveguide connection comprising:

a pair of tubular-shaped circular waveguides mounted adjacent each other, for transmission of microwave energy therebetween, with the longitudinal axis of the waveguides aligned but with the waveguides physically spaced apart longitudinally;

a tubular shaped circular waveguide connector, said connector having its longitudinal dimension greater than said spacing and the connector diameter dimensions relative to diameters of said two waveguides being such that said connector when placed between said two waveguides forms a slidable coaxial connection with said two waveguides and forms a coaxial gap between at least one of said two waveguides and the connector, wherein said connector functions as an expansion joint while providing for the efficient transfer of microwave energy between said pair of waveguides through said connector;

absorber means for preventing the emission of electromagnetic radiation from said gap into free space; and alignment means providing coaxial alignment of said connector and said at least one waveguide with which said connector forms said gap.

27. The waveguide connection of claim 26 wherein the absorber means includes an absorber ring located within the gap.

28. The waveguide connection of claim 27 wherein the absorber ring is formed of a ferrite-based material.

29. The waveguide connection of claim 27 wherein the absorber ring is formed of carbon loaded silicone rubber for preventing the emission of electromagnetic radiation from the gap into free space and for pressure sealing the gap.

30. The waveguide connection of claim 27 wherein the alignment means includes an alignment ring located within the gap, said alignment ring and the absorber ring for providing coaxial alignment of the connector and the waveguide with which the connector forms the gap.

31. The waveguide connection of claim 26 wherein the alignment means includes two alignment rings located within the gap for providing coaxial alignment of the connector and the waveguide with which the connector forms the gap.

32. The waveguide connection of claim 26 including means for pressure sealing the gap to maintain a pressurized condition within the pair of circular waveguides and the connector.

33. A waveguide connector adapted for joining a first circular waveguide with a second circular waveguide for propagating electromagnetic energy in the microwave range in a preselected mode, wherein the axes of the first and the second circular waveguides are aligned but with the first and the second circular waveguides physically spaced apart longitudinally, said connector comprising a tubular shaped circular waveguide member, said member having its longitudinal dimension greater than said spacing and the member diameter dimensions relative to diameters of the first and the second waveguides being such that said member when placed between the first and the second waveguides forms a slideable coaxial connection therewith, and forms a coaxial gap between at least one of the first and the second waveguides and said member, wherein said connector functions as an expansion joint providing for the efficient transfer of microwave energy between the first and the second waveguides through said connector;

absorber means for preventing the emission of electromagnetic radiation from said gap into free space; and alignment means providing coaxial alignment of said connector and said one of said first and said second waveguides with which said connector forms said gap.

34. The waveguide connector of claim 33 wherein the absorber means includes an absorber ring located within the gap.

35. The waveguide connector of claim 34 wherein the absorber ring is formed of a ferrite-based material.

36. The waveguide connector of claim 34 wherein the absorber ring is formed of carbon loaded silicone rubber for preventing the emission of electromagnetic radiation from the gap into free space and for pressure sealing the gap.

37. The waveguide connector of claim 34 wherein the alignment means includes an alignment ring located within the gap, said alignment ring and the absorber ring for providing coaxial alignment of the connector and the one of the first and the second waveguides with which the connector forms the gap.

38. The waveguide connector of claim 33 wherein the alignment means includes two alignment rings located within the gap for providing coaxial alignment of the waveguide connector and the one of the first and the second waveguides with which the connector forms the gap.

39. The waveguide connector of claim 33 including means for pressure sealing the gap to maintain a pressurized condition with the first and the second circular waveguides and the waveguide connector.

* * * * *